US008019491B1

(12) United States Patent
McCusker

(10) Patent No.: US 8,019,491 B1
(45) Date of Patent: Sep. 13, 2011

(54) GENERATING LATERAL GUIDANCE IMAGE DATA IN A TERRAIN AWARENESS AND WARNING SYSTEM

(75) Inventor: Patrick D. McCusker, Walker, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 975 days.

(21) Appl. No.: 11/904,483

(22) Filed: Sep. 27, 2007

(51) Int. Cl.
*G08B 23/00* (2006.01)

(52) U.S. Cl. ..... 701/4; 701/14; 701/19; 701/29; 701/5; 701/25; 701/26; 701/27; 701/28; 701/9; 701/30; 340/945; 340/965; 340/967; 340/963; 340/974; 340/975

(58) Field of Classification Search ..... 701/3–18; 340/945, 965–967, 963, 974, 975
See application file for complete search history.

(56) References Cited

U.S. PATENT DOCUMENTS

| | | | | |
|---|---|---|---|---|
| 4,914,436 | A | 4/1990 | Bateman et al. | |
| 5,839,080 | A | 11/1998 | Muller et al. | |
| 6,092,009 | A | 7/2000 | Glover | |
| 6,122,570 | A | 9/2000 | Muller et al. | |
| 6,138,060 | A | 10/2000 | Conner et al. | |
| 6,219,592 | B1 | 4/2001 | Muller et al. | |
| 6,529,821 | B2 * | 3/2003 | Tomasi et al. | 701/202 |
| 6,980,892 | B1 * | 12/2005 | Chen et al. | 701/9 |
| 7,145,501 | B1 | 12/2006 | Manfred et al. | |
| 7,337,043 | B2 * | 2/2008 | Bull | 701/1 |
| 7,714,744 | B1 * | 5/2010 | Wichgers | 340/965 |
| 2003/0107499 | A1 * | 6/2003 | Lepere et al. | 340/945 |
| 2007/0174005 | A1 * | 7/2007 | Bitar et al. | 701/211 |
| 2007/0265776 | A1 * | 11/2007 | Meunier et al. | 701/301 |

* cited by examiner

*Primary Examiner* — Jack Keith
*Assistant Examiner* — Adam Tissot
(74) *Attorney, Agent, or Firm* — Matthew J. Evans; Daniel M. Barbieri

(57) ABSTRACT

A system and method for generating lateral guidance image data and presenting information representative of the image data is disclosed. A system is disclosed for determining lateral guidance information based upon the elevation of terrain cells and a level of terrain threat associated with the elevation. A left or right turn angle, or both could be formed between a projected flight path and a vector extending to a tangent point of a terrain boundary to the left and right, respectively. The degree of angle could be determined for each, and lateral guidance image data based upon the boundary location of a level of terrain threat with respect to the projected flight path determined. A lateral processor provides an alert signal associated with the generation of the lateral guidance information and provide such signal to a crew visual and aural alerting system.

13 Claims, 11 Drawing Sheets

186 First Level of Terrain Threat

188 Second Level of Terrain Threat

190 Third Level of Terrain Threat

GENERATING LATERAL GUIDANCE IMAGE DATA IN A TERRAIN AWARENESS AND WARNING SYSTEM

BACKGROUND OF THE INVENTION

1. Field of the Invention

This invention pertains to the terrain awareness and warning system of an aircraft.

2. Description of the Related Art

Beginning in the early 1970's, a number of studies looked at the occurrence of "controlled flight into terrain" (CFIT)-type accidents, where a properly functioning airplane under the control of a fully qualified and certificated crew is flown into terrain (or water or obstacles) with no apparent awareness on the part of the crew. Findings from these studies indicated that many such accidents could have been avoided if a warning device called a ground proximity warning system ("GPWS") was used. There have been numerous patents issued in the field of GPWS and related art. A sampling of patents issued in the art and related art include U.S. Pat. Nos. 5,839,080; 6,092,009; 6,122,570; 6,138,060; 6,219,592; and 7,145,501.

Advances in technology have permitted vendors and designers of avionics equipment to develop newer type of GPWS that provides greater situational awareness for flight crews. The U.S. Federal Aviation Administration ("FAA") has classified such systems as Terrain Awareness and Warning Systems ("TAWS"). The advancement of technologies—more precise navigation systems, increased computer memory storage, and better display technology—have allowed further development of in the common features of TAWS: (1) use of airplane position information from the aircraft's navigation system(s), (2) an onboard terrain database, and (3) a means of displaying the surrounding terrain. Aircraft position information from the aircraft's navigation system is fed to a TAWS computer. The TAWS computer compares the airplane's current position and flight path with the terrain database associated with the system. If there is a potential threat of collision with terrain, the TAWS computer sends warning alerts to the airplane's audio system.

Manufactures have produced cockpit indicators for presenting terrain information to the pilot. For instance terrain information may be depicted in three colors (e.g., red, yellow, and green) and variable density dot patterns. Each of the colors and patterns, such as those discussed in U.S. Pat. No. 6,122,570, could indicate a different level of terrain threat in front of the aircraft. For example, a high density dot pattern that could be associated with a first level of terrain threat may be defined as a function of the altitude. A high density dot pattern could be associated with a color such as red, a color traditionally associated with a warning alert of TAWS. Likewise, medium and low density dot patterns that could be associated with second and third levels of terrain threat, respectively, may be defined as a function of the altitude. Medium and low density dot patterns could be associated with different colors such as amber and green, where amber is a color traditionally associated with a caution alert of TAWS.

Although the use of levels of terrain threat has been used to depict terrain on an indicator, lateral terrain guidance is generally not. The embodiments disclosed herein present novel and non-trivial system and method for generating and presenting lateral guidance image data based upon locations of terrain cells associated with a level of terrain threat.

BRIEF SUMMARY OF THE INVENTION

A novel and non-trivial system and method for generating lateral guidance image data and presenting information representative of the image data is disclosed. A system is disclosed comprising of a navigation system, a terrain database, an airport database, a lateral guidance processor, a terrain indicating system. A crew alerting system may also be embodied. The navigation system acquires navigation data representative of aircraft position, altitude, attitude, direction of flight. A terrain database stores terrain data including data representative of minimum operating altitudes associated with terrain cells and dependent on a phase of flight and flight attitude. An airport database stores airport-related data and may be used to define the phase of flight and flight attitude parameter.

In one embodiment, a lateral guidance processor receives navigation data, retrieves airport-related data, determines the phase of flight and flight attitude parameter, retrieves a minimum operating altitude based on the location of the terrain cell and phase of flight and flight attitude parameter, and triggers a terrain threat if the aircraft altitude is equal to or less than the minimum operating altitude. The lateral guidance processor determines a minimum left turn angle and a minimum right turn angle which will avoid any detected terrain threat. Then, the lateral guidance processor generates lateral guidance and provides it to the terrain indication system for subsequent presentation to the pilot.

In another embodiment, a method for generating lateral guidance image data and presenting information representative of the image data is disclosed. Navigation data may be received, airport-related data may be retrieved, and a phase of flight and flight attitude parameter may be determined. Then, a minimum operating altitude may be retrieved from a terrain database, and a terrain threat could be triggered is the aircraft altitude is equal to or less than the retrieved minimum operating altitude data. If a terrain threat is triggered, lateral guidance image data that is representative of one or two angles may be generated, and this image data may be provided to a terrain indicating system.

DETAILED DESCRIPTION OF THE INVENTION

In the following description, several specific details are presented to provide a thorough understanding of embodiments of the invention. One skilled in the relevant art will recognize, however, that the invention can be practiced without one or more of the specific details, or in combination with other components, etc. In other instances, well-known implementations or operations are not shown or described in detail to avoid obscuring aspects of various embodiments, of the invention.

Figure 1:
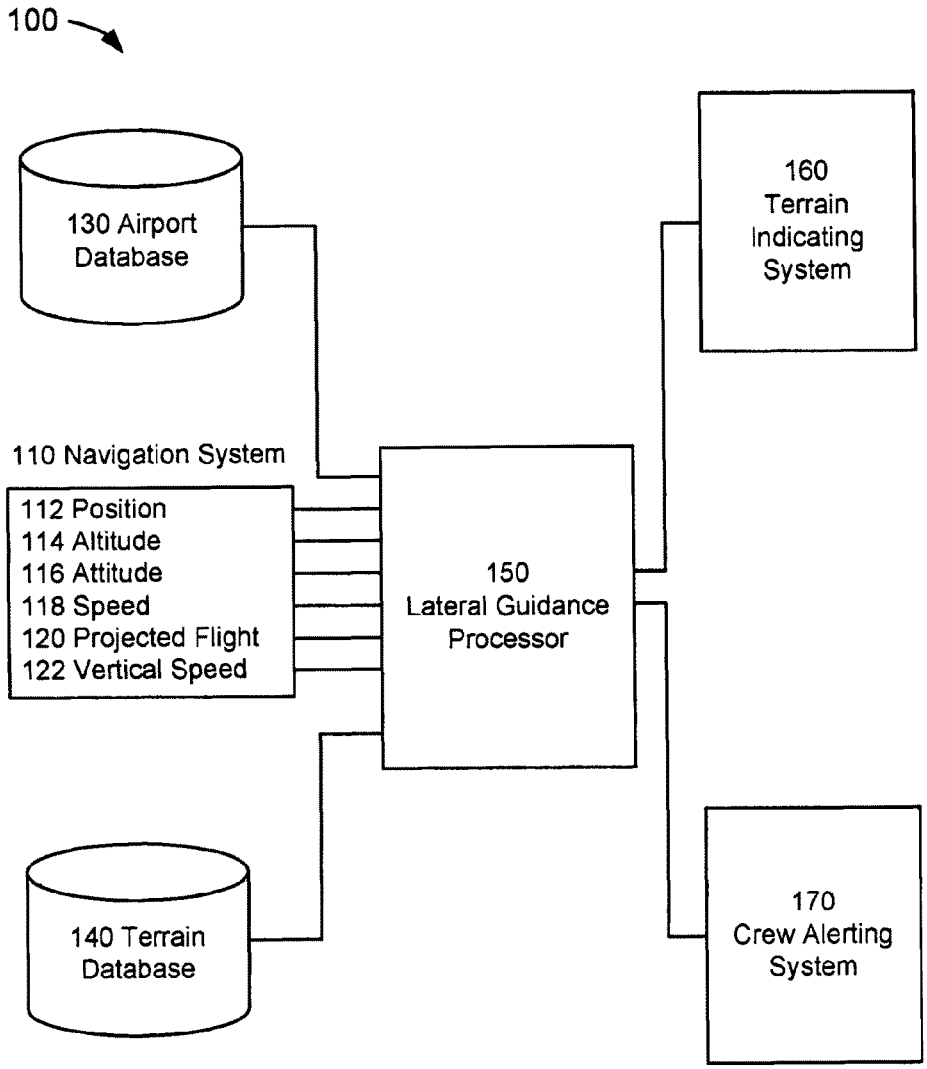
FIG. 1 depicts a block diagram of a system generating lateral guidance image data and presenting information representative of the image data to a terrain awareness and warning system.

FIG. 1 depicts a forward looking terrain avoidance system 100 suitable for implementation of the techniques described herein. The system may be comprised of a navigation system 110, an airport database 130, a terrain database 140, a lateral guidance processor 150, a terrain indicating system 160. and a crew alerting system 170.

A navigation system 110 includes those systems that provide navigation data information to the pilot. A navigation system 110 may include, but is not limited to an air/data system, attitude heading reference system, an inertial guidance system (or inertial reference system), global navigation satellite system (or satellite navigation system), and flight management computing system, of all which are known to those skilled in the art. As embodied herein, a navigation system 110 could provide navigation data including, but not limited to, aircraft position 112, altitude 114, attitude 116, speed 118, projected flight path 120, and vertical speed 122 to a lateral guidance processor 150 for subsequent processing as discussed herein. Navigation data may be used, in part, to identify a phase of flight of an aircraft in flight and flight attitude, two parameters which may be used to define minimum terrain clearance standards in a terrain awareness and warning system. Such navigation data may be used, in part, to identify a phase of flight and flight attitude.

An airport database 130 may be used to store airport-related data including, but not limited to, airport and runway information. Airport information could include surveyed location and elevation data, and runway information could include surveyed location and elevation data of the runway and runway threshold. Airport-related data may be used, in part, to identify a phase of flight of an aircraft in flight, a parameter which may be used to define minimum terrain clearance standards in a terrain awareness and warning system. An example of a database which may provide a source of airport-related data as embodied herein may be a navigation database included as part of a flight management computing system. As embodied herein, an airport database 130 could provide airport-related data to a lateral guidance processor 150 for subsequent processing as discussed herein.

A terrain database 140 may be used to store terrain data contained in digital elevation models ("DEM"). Generally, the terrain data of a DEM is stored as grids, and each grid represents an area of terrain. A grid is commonly referred to as a terrain cell. A grid may be of various shapes. For example, a grid may be a square cell defined in arc-minutes of latitude and longitude, or a grid may be circular. A grid may also be of differing resolutions. For instance, the U.S. Geological Society developed GTOPO30, a global DEM which may provide 30 arc-seconds (approximately 900 meters) resolution. On the other hand, the Space Shuttle Endeavour in February 2000 acquired elevation data known as Shuttle Radar Topography Mission ("SRTM") terrain elevation data which may provide generally one arc-second (or approximately 30 meters) resolution, providing much greater detail than that provided with GTOPO30 data set by an approximately ratio of 900:1. At the present time, resolutions of one-arc second for SRTM terrain data are available for areas over the United States; for all other locations, resolutions of three arc-seconds (approx. 90 meters) are available. In addition to these public sources of terrain data, various vendors and designers of avionics equipment have developed databases that have been, for all intents and purposes, proprietary in nature.

Typically, data contained in a terrain data cell may include the value of the highest elevation found within the cell. In an embodiment herein, a terrain database 140 could provide a plurality of terrain cells, each having the value of the highest elevation found within the cell. In an alternative embodiment, data contained in a terrain cell could be comprised of a minimum operating altitude which could be the sum of the highest elevation found within the terrain cell and a required terrain clearance altitude specified in a terrain awareness and warning system, where the minimum operating altitude may depend upon a phase of flight (e.g., enroute, terminal, approach, and departure) and flight attitudes (e.g., level, descent, and climb). If terrain data is comprised of minimum operating altitudes, then terrain database 140 could store a minimum operating altitude per phase of flight and flight altitude in one embodiment. In another embodiment, a terrain database 140 may be comprised of one or more databases where each database stores one or more minimum operating altitudes corresponding to specific phases of flight and flight attitudes.

A lateral guidance processor 150 may receive input data from various systems including, but not limited to, a navigation system 110, an airport database 130, and a terrain database 140 for processing as discussed herein. The input may be used to trigger a terrain threat, determine one or two turn angles, and generate lateral guidance data representative of one or both angles. The triggering of a terrain threat may also generate output data or signals that are provided to various systems including, but not limited to, a terrain indicating system 160 and a crew alerting system 170. For example, a lateral guidance processor 150 may provide lateral guidance image data that is representative of one or two angle to a crew indicating system 160 and one or more alerts signals to a crew alerting system 170 for providing aural and visual alerts to the pilot as discussed herein.

A lateral guidance processor 150 may receive input data from various systems including, but not limited to, a navigation system 110, an airport database 130, and a terrain database 140 for processing as discussed herein. A lateral guidance processor 150 may be electronically coupled to a navigation system 110, an airport database 130, and a terrain database 140 to facilitate the receipt of input data. It is not necessary that a direct connection be made; instead, such receipt of input data could be provided through a data bus or through a wireless network.

A lateral guidance processor 150 may be any electronic data processing unit which executes software or source code stored, permanently or temporarily, in a digital memory storage device or computer-readable media (not depicted herein) including, but not limited to, RAM, ROM, CD, DVD, hard disk drive, diskette, solid-state memory, PCMCIA or PC Card, secure digital cards, and compact flash cards. A lateral guidance processor 150 may be driven by the execution of software or source code containing algorithms developed for the specific functions embodied herein. Common examples of an electronic data processing unit include microprocessors and signal processors; however, for the embodiments herein, the term processor is not limited to the microprocessor and its meaning is not intended to be construed narrowly. For instance, a lateral guidance processor 150 could also consist of more than one electronic data processing units.

A terrain indicating system 160 could include any system that provides terrain information to the pilot or is shared with other aircraft systems that provide flight and system information on an indicator or display unit including, but are not limited to, a strategic display unit system. The displaying of such information from multiple sources could be the result of overlaying, a presentation technique known to those skilled in the art. A strategic display system could be a system which presents information to the crew relative to the intended future state(s) of the aircraft (e.g. intended location in space at specified times) along with information providing contextual information the crew (e.g. terrain, navigation aids, geopolitical boundaries, airspace boundaries, etc.) about such state(s). One example of such display unit is commonly referred to as a Navigation Display. In some configurations, the strategic display unit could be part of an Electronic Flight Information System ("EFIS"). On these systems, terrain information may be displayed simultaneously with information of other systems. In one embodiment herein, terrain information may be displayed simultaneously with weather information with no loss or a negligible loss of displayed information.

A terrain indicating system 160 may receive input data from various systems including, but not limited to, terrain indicating system 160 for processing as discussed herein. A terrain indicating system 160 may be electronically coupled to a lateral guidance processor 150 to facilitate the receipt of input data. It is not necessary that a direct connection be made; instead, such receipt of input data could be provided through a data bus or through a wireless network.

A crew alerting system 170 includes those systems that provide, in part, aural and visual alerts to the pilot, alerts that could be visual, aural, or tactile stimulus presented to attract attention and convey information regarding system status or condition. A crew alerting system 160 may include, but is not limited to, an aural alert unit for producing aural alerts and a display unit for producing visual alerts. Aural alerts may be discrete sounds, tones, or verbal statements used to annunciate a condition, situation, or event. Visual alerts may be projected or displayed information that presents a present condition, situation, or event to the pilot on a cockpit display unit. In addition, alerts may be based on conditions requiring immediate crew awareness or attention. Caution alerts may be alerts requiring immediate crew awareness in which subsequent corrective action will normally be necessary. Warning alerts may be alerts for detecting terrain threat that requires immediate crew action. Both caution and warning alerts may be presented as aural alerts, visual alerts, or both simultaneously. When presented visually, one or more colors may be presented on a display unit indicating one or more levels of alerts. For instance, yellow may indicate a caution alert and red may indicate a warning alert.

A terrain indicating system 160 and a crew alerting system 170 may receive input data from various systems including, but not limited to, lateral guidance processor 150 for processing as discussed herein. A terrain indicating system 160 and a crew alerting system 170 may be electronically coupled to a lateral guidance processor 150 to facilitate the receipt of input data. It is not necessary that a direct connection be made; instead, such receipt of input data could be provided through a data bus or through a wireless network.

Figure 2:
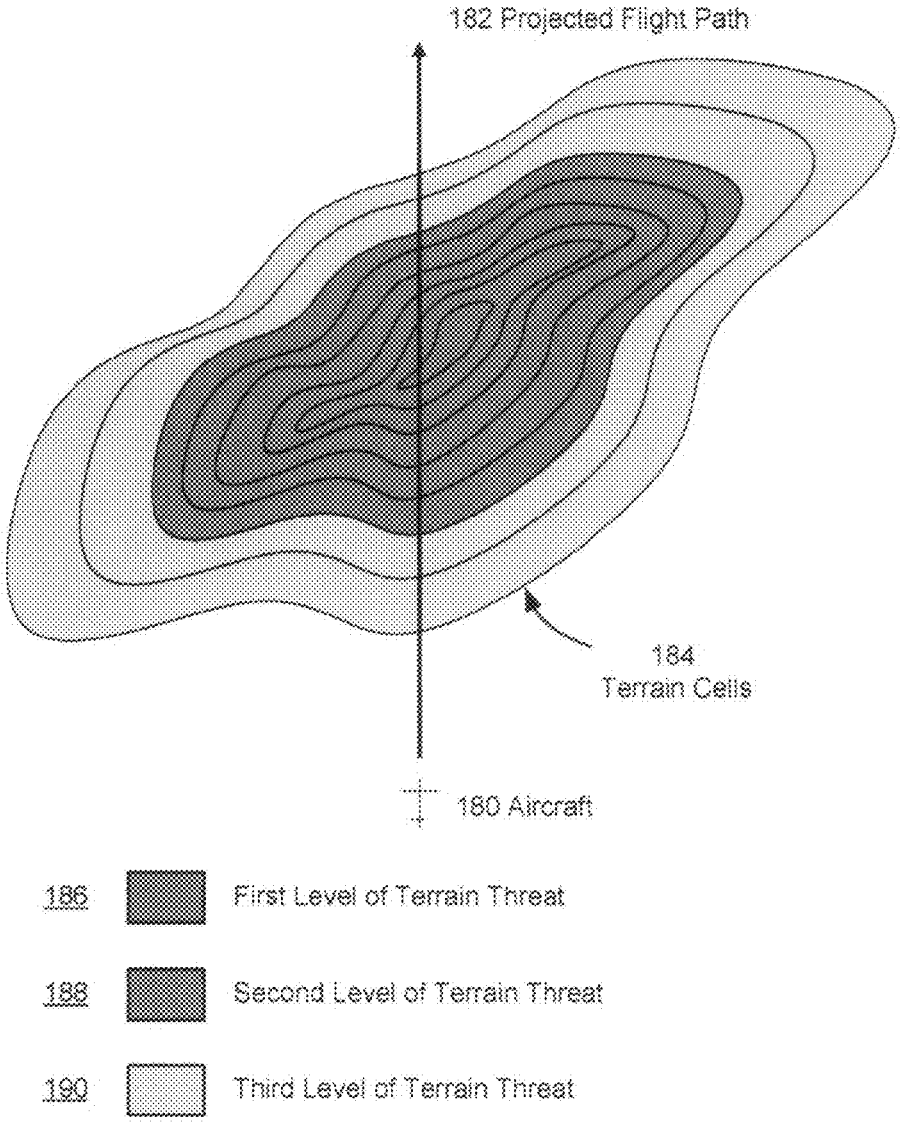
FIG. 2 depicts an exemplary illustration of terrain over which an aircraft may operate.

The advantages and benefits of the embodiments discussed herein may be illustrated by showing examples of the plurality of altitudes defined herein which could provide terrain avoidance assurance. FIG. 2 depicts a "bird's eye" view of an aircraft 180 and a projected flight path 182 of the aircraft over terrain cells 184. The terrains cells 184 are grouped by respective levels of threat. Item 186 depicts the darkest shading of the terrain cells 184 corresponding to a first level of terrain threat, item 188 depicts a lighter shading of terrain cells 184 corresponding to a second level of terrain threat, and item 190 depicts the lightest shading of terrain cells 184 corresponding to a third level of threat. It should be noted that each level may have be presented on the display as color that corresponds to a specific level of terrain threat. For example, red could be associated with a first level of threat, amber or yellow could be associated with the second level, and green could be associated with a third level.

The levels of threat could be associated with a level of elevation of the terrain cells 184 with reference to the altitude 114 of the aircraft or determined as a function of the altitude 114. For example, a first level of terrain threat could indicate terrain that is more than 2000 feet above the altitude 114. Likewise, a second level of terrain threat could indicate terrain that is between 500 feet below and 2000 feet above the altitude 114, and a third level of terrain threat could indicate terrain that is 500 feet to 2000 feet below the altitude 114. The preceding examples of colors, altitudes, and number of terrain threat levels are provided as illustrations and not limitations. In one embodiment, one terrain threat or a plurality terrain threats may be displayed. In another embodiment, one color or a plurality of colors may be displayed where each color may correspond to a level of terrain threat. In another embodiment, the range of altitude which corresponds to a level of terrain threat may be comprised of any value or values selected by the user.

Figure 3:
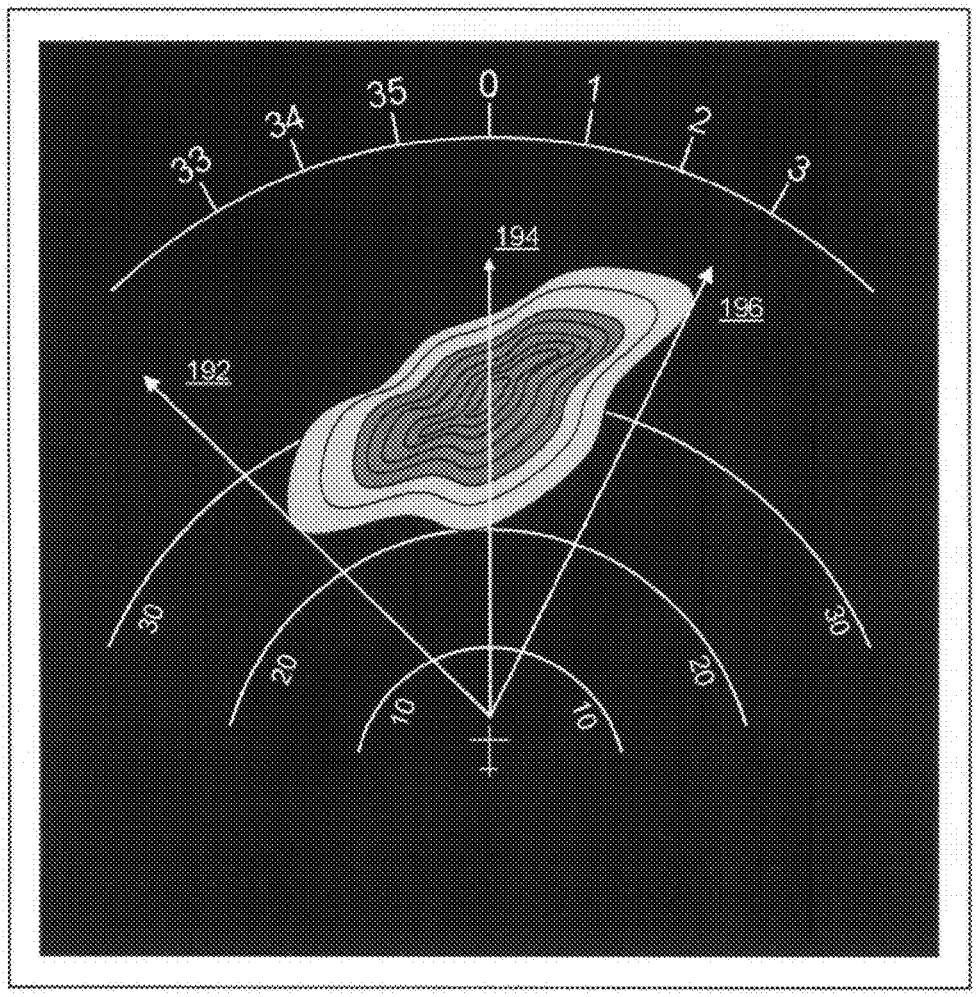
FIG. 3 depicts an exemplary illustration of terrain over which an aircraft may operate a depicted on a strategic display unit.

FIG. 3 provides an exemplar depiction of a strategic display unit presenting terrain cells 184. As a preliminary matter, the strategic display unit could display an extensive amount of information to the pilot, information that could be provided from a plurality of aircraft systems. It should be noted that the extensiveness of this information has been intentionally omitted from the strategic display unit shown in FIG. 3 for the sake of the presentation only and discussion that follows herein. The omission of a plurality of indications or information is not indicative of the plurality of indications or information with which the presentation of terrain information disclosed herein may be configured, nor is it intended to be a limitation of the embodiments disclosed herein.

FIG. 3 depicts lateral guidance information embodied herein. As shown, the projected flight path 182 of the aircraft indicates the aircraft will fly directly over the terrain cells corresponding to a first level of terrain threat 186. Using the elevation figures discussed above and assuming for the sake of discussion the aircraft is flying at an altitude of 10,000 feet above sea level, then the terrain cells associated with the first level of terrain threat 186 have an elevation range of 12,000 feet above sea level and higher. Likewise, the terrain cells associated with the second level of terrain threat 188 have an elevation range between 9,500 feet and 12,000 feet above sea level, and the terrain cells associated with the third level of terrain threat 190 have an elevation range of 9,500 feet above sea level and lower. Thus, with this presentation of information on the strategic display, a pilot will know that a controlled flight into terrain ("CFIT") situation will occur unless the aircraft is turned away from the terrain cells.

FIG. 3 illustrates lateral guidance information based upon the elevation of terrain cells as embodied herein. Vector 192 forms a left turn angle with the projected flight path vector 194, and vector 196 forms a right turn angle with the projected flight path vector 194. A lateral guidance processor 150 could determine the location of path vectors 192 and 196 by determining the tangent point of a terrain boundary to the left and right, respectively. The degree of each angle is the measurement between the projected flight path 194 and the tangent boundary of a level of threat. A lateral guidance processor 150 could be configured to determine the location of the boundary of the terrain cells associated with a third level of terrain 190 to the left and right of the projected flight path 194.

In an embodiment herein, the lateral guidance processor 150 could determine the smaller of the two angles, generate lateral image data representative of the smaller angle, and provide this image data to a terrain indicating system 160. In another embodiment, the lateral guidance processor 150 could generate lateral image data representative of the larger angle, and provide this image data to a terrain indicating system 160 for overlay display. In another embodiment, the lateral processor could generate an alert signal associated with the generation of the lateral guidance information and provide such signal to a crew alerting system 170, wherein a visual alert could be displayed on a display unit and an aural alert could be presented to the pilot by an aural alert unit. In another embodiment, an alert signal could be associated with a level of terrain threat. For example, the lateral guidance processor 150 could generate a signal associated with a warning alert and caution alert of a terrain awareness and warning system, and such signal could be associated with a specific color; for instance, a warning signal could be associated with red, and a caution signal could be associated with amber.

Figure 4:
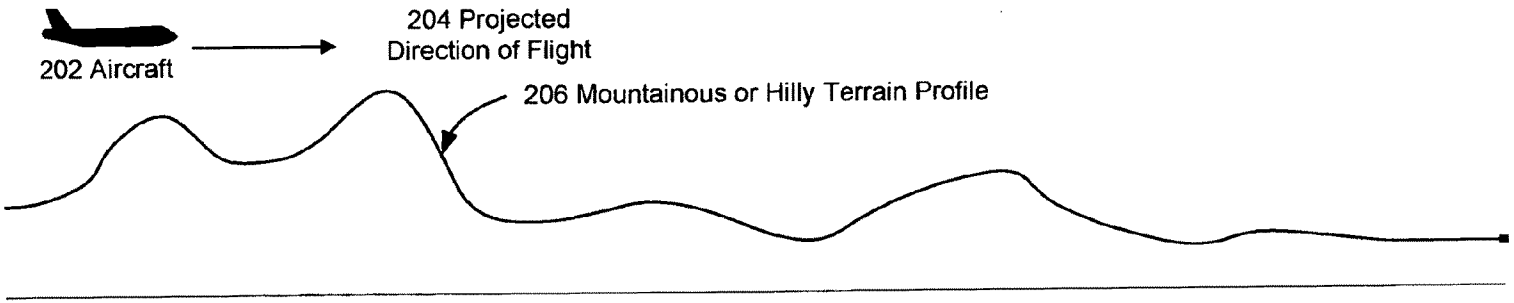
FIG. 4 depicts an exemplary illustration of a profile of a mountainous or hilly terrain over which an aircraft may operate.
Figure 5:
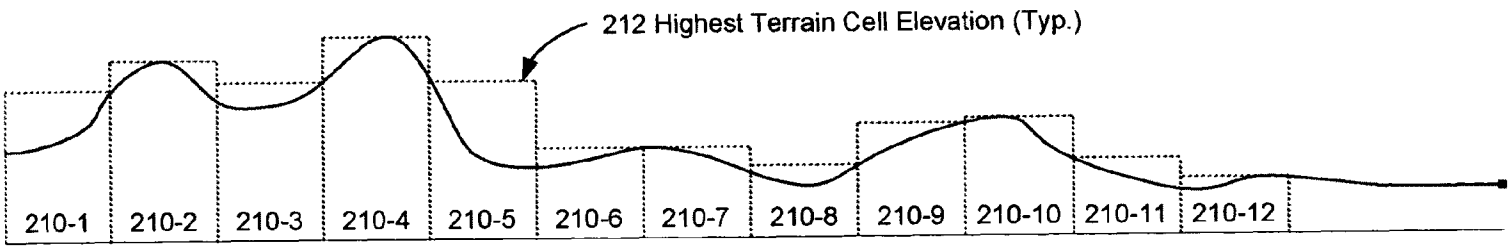
FIG. 5 depicts an exemplary illustration of a plurality of terrain cells corresponding to the mountainous or hilly terrain.
Figure 6:
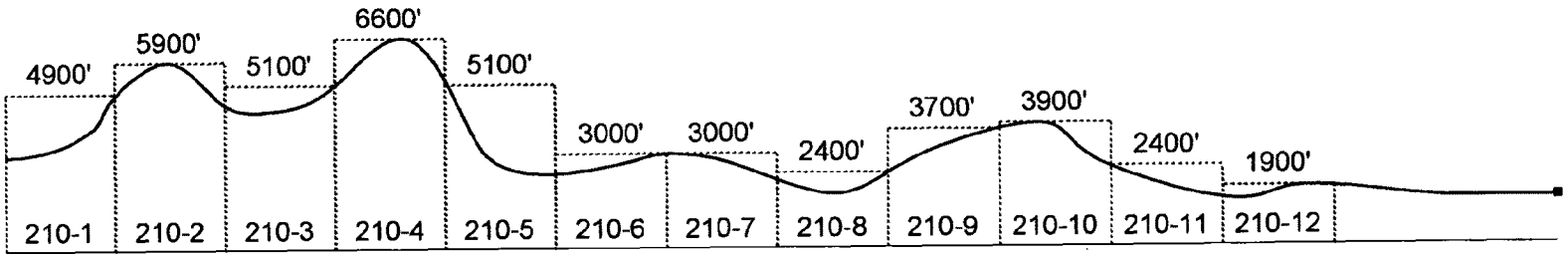
FIG. 6 provides an exemplary illustration of a plurality of terrain cell elevation data corresponding to the mountainous or hilly terrain.

FIG. 4 provides an exemplar depiction of a profile of a mountainous or hilly terrain 200 over which an aircraft 202 may encounter in the projected direction of flight 204. The profile presented in FIG. 4 does not correspond to the terrain depicted in FIGS. 2 and 3. FIG. 5 provides an illustration of a plurality of terrain cells 210-1 through 210-12 corresponding to the mountainous or hilly terrain 200 in the projected flight path 204. Once the plurality of projected terrain cells have been identified, the value of the highest terrain cell elevation 212 for each projected terrain cell may be identified. The values of corresponding to the highest terrain cell elevation 212 of each terrain are shown in FIG. 6. Is should be noted that the values have been randomly selected for the purposes of discussion and illustration only.

Figure 7:
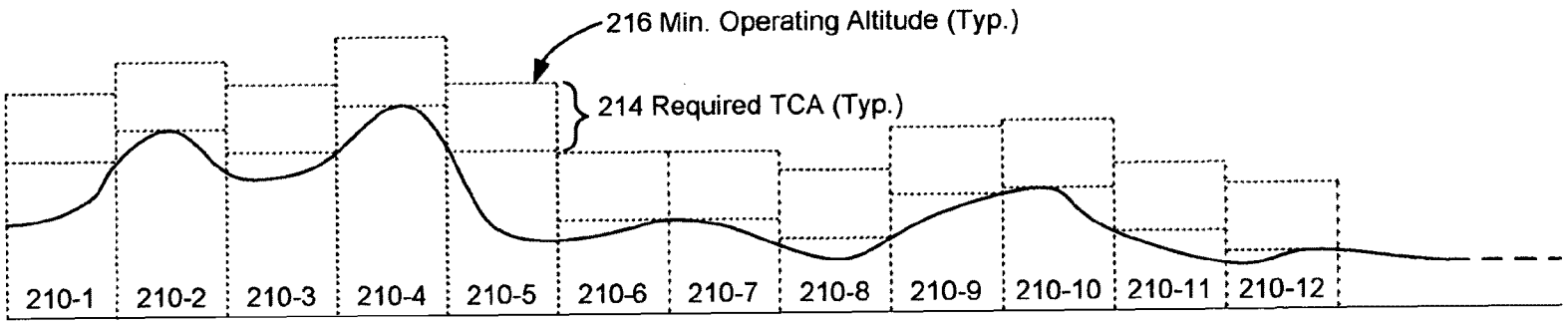
FIG. 7 provides an exemplary illustration of terminologies that may be used in the embodiments herein.

FIG. 7 provides an exemplar depiction of a required terrain clearance altitude ("required TCA") 214 and minimum operating altitude 216 for a typical terrain cell. The value of a required TCA 214 may not remain constant between take-off and landing. Instead, the value of a required TCA 214 may depend on the different phases of flight (e.g., terminal, approach, departure, and enroute), flight attitudes (e.g., level, descending, or climbing flight), or both.

A terminal phase of flight could exist when the aircraft is a pre-defined distance (e.g., 15 nautical miles) or less from the nearest runway while the range to the nearest runway threshold is decreasing and the aircraft is operating at or below (lower than) an upper terminal phase boundary altitude, where the value of the upper terminal phase boundary altitude varies as a function of height above runway and distance to the runway. Generally, the terminal phase of flight ends where the approach phase begins.

An approach phase of flight could exist when the aircraft is a pre-defined distance (e.g., 5 nautical miles) or less to the nearest runway threshold, the height above the elevation of the nearest runway threshold location is equal to or less than a pre-defined altitude (e.g., 1,900 feet), and distance to the nearest runway threshold is decreasing.

A departure phase of flight could exist if an aircraft is on the ground upon initial power-up. A reliable parameter may be used to determine whether or not the aircraft is on the ground. For example, one parameter which could initially determine the aircraft to be on the ground could be a signal generated by a "squat switch" to indicate whether or not the aircraft is on the ground. Other parameters such as speed and altitude could be used to determine if the aircraft is on the ground or airborne. For example, an aircraft could be "on the ground" if it is operating at a speed less than 35 knots and an altitude within +/−75 feet of field elevation or the elevation of the nearest runway. Similarly, an aircraft could be "airborne" if it is operating at a speed greater than 50 knots and an altitude 100 feet greater than field elevation; in this example, it can be reliably determined that the aircraft is operating in the departure phase of flight. Other parameters which may be considered are the distance from departure runway and climb state. Once the aircraft reaches a pre-defined altitude (e.g., 1,500 feet above the departure runway), the departure phase could end.

An enroute phase of flight may exist anytime the aircraft is more than a pre-defined distance (e.g., 15 nautical miles) from the nearest airport or whenever the conditions for terminal, approach and departure phases of flight are not met.

As embodied herein, the value of a required TCA 214 may depend on a phase of flight and flight attitude. For example, if an aircraft is operating in the enroute phase of flight, a required TCA 214 could be 700 feet if operating in level flight attitude and 500 feet if operating in descending flight attitude. In another example, if an aircraft is operating in the terminal phase of flight, a required TCA 214 could be 350 feet if operating in level flight attitude and 300 feet operating in descending flight attitude. In another example, if an aircraft is operating in the approach phase of flight, a required TCA 214 could be 150 feet if operating in level flight attitude and 100 feet operating in descending flight attitude. The value of a required TCA 214 may depend on the phase of flight and not flight attitude. For example, if an aircraft is operating in the departure phase of flight, a required TCA 214 could be set to one value (e.g., 100 feet) irrespective of flight attitude. It should also be noted that level flight attitude may or may not include aircraft operating at relatively low vertical speeds and the values may differ across the phases of flight. For example, an aircraft climbing or descending at a rate of 500 per minute or less may be considered as operating in level flight in one phase of flight but not in another.

In one embodiment herein, an aircraft may be operating above a minimum operating altitude 216 in a descending phase of flight. In such operation, one or more than alerts may be generated at a height above terrain configurable as a function of the phase of flight and flight attitude parameter and the vertical speed data through which the aircraft is descending. For example, in an enroute phase of flight, one alert such as a caution alert may be generated at an altitude of 1200 feet above the terrain if the aircraft is descending at a rate of 1000 feet per minute and 2100 feet above the terrain if descending at 4000 feet per minute. In another example, in the enroute phase of flight, another alert such as a warning alert may be generated at an altitude of approximately 570 feet above the terrain if an aircraft is descending at a rate of 1000 feet per minute and approximately 980 feet if descending at a rate of 4000 feet per minute.

In another example, in a terminal phase of flight, a caution alert may be generated at an altitude of 700 feet above the terrain if the aircraft is descending at a rate of 1000 feet per minute and 1100 feet above the terrain if descending at 3000 feet per minute. In another example, in the terminal phase of flight, a warning alert may be generated at an altitude of approximately 330 feet above the terrain if an aircraft is descending at a rate of 1000 feet per minute and approximately 500 feet if descending at a rate of 3000 feet per minute.

In another example, in an approach phase of flight, a caution alert may be generated at an altitude of 350 feet above the terrain if the aircraft is descending at a rate of 500 feet per minute and 550 feet above the terrain if descending at 1500 feet per minute. In another example, in the approach phase of flight, a warning alert may be generated at an altitude of approximately 110 feet above the terrain if an aircraft is descending at a rate of 500 feet per minute and approximately 160 feet if descending at a rate of 1500 feet per minute.

Those skilled in the art will recognize the values used in the preceding examples are associated with some of the minimum performance standards of a Terrain Awareness and Warning System ("TAWS") published by the United States Federal Aviation Administration ("FAA") in TSO-C151b. Although TSO-C151b states specific values of minimum terrain clearance altitudes, those skilled in the art will readily acknowledge that aviation regulatory authorities such as the FAA may modify minimum performance standards with subsequent changes, amendments, or revisions. In addition, other aviation regulatory authorities could develop separate minimum performance standards which differ from those published by the FAA. In addition, a pilot or owner of an aircraft may decide to configure one or more of the parameters discussed above. The embodiments and discussion herein with respect to phases of flight and values of required TCAs 214 are illustrations intended solely to provide examples and are in no way intended to be limited to those discussed and presented herein. As embodied herein, the terrain alerting processor 150 may determine phase of flight, flight attitude, and required TCA 214 data using on algorithms programmed in executable software code. Those skilled in the art will appreciate the ability and ease with which executable software code may be reprogrammed or modified to facilitate subsequent or concurrent performance standards without affecting or expanding the scope of the embodiments discussed herein.

Figure 9:
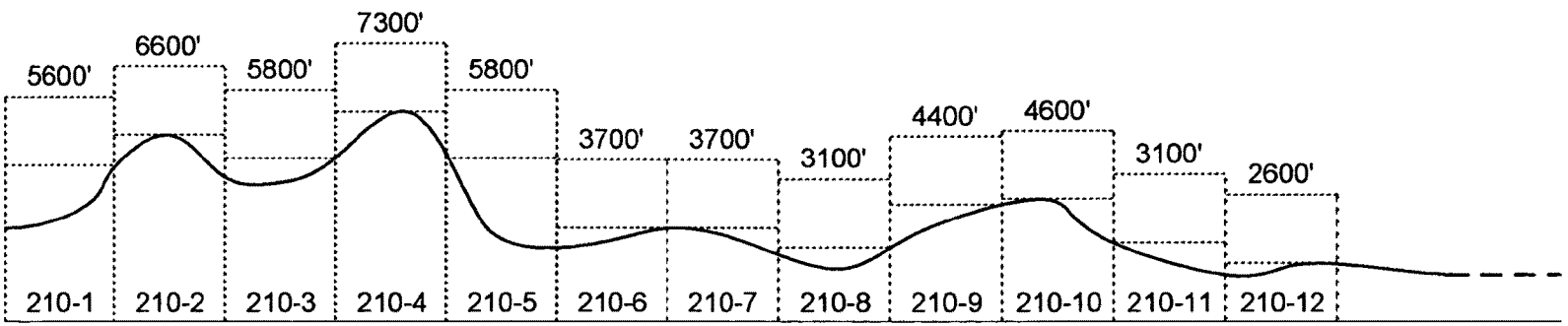
FIG. 9 provides an exemplary illustration of a plurality of terrain cell altitude data.

FIG. 7 provides an illustration of an application of a minimum operating altitude 216 for each terrain cell. As shown in FIG. 9, a minimum operating altitude 216 for a terrain cell may be determined by adding the highest terrain cell elevation 212 (shown in FIG. 5) to the required TCA 214.

Figure 8:
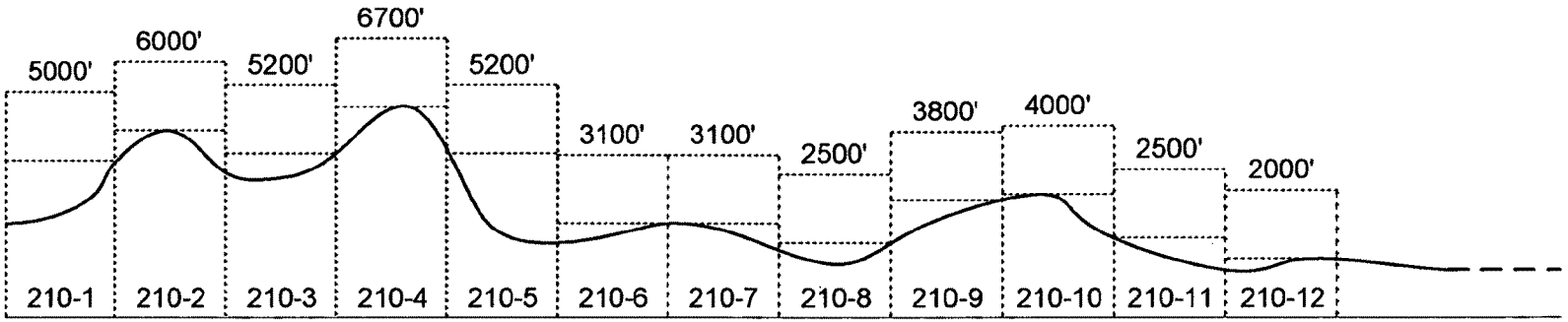
FIG. 8 provides an exemplary illustration of a plurality of terrain cell altitude data.

FIG. 8 illustrates the determination of the minimum operating altitude 216 for each terrain cell based upon an aircraft operating in the approach phase of flight in a descending flight attitude where a required TCA 214 has been set to 100 feet, the illustrative value of the required TCA 214 discussed above. A comparison between the values shown in FIG. 6 and FIG. 8 shows the 100 feet difference for each terrain cell, the value of the required TCA 214 of a descending aircraft in the approach phase of flight.

FIG. 9 illustrates the determination of the minimum operating altitude 216 for each terrain cell based upon an aircraft operating in the enroute phase of flight in a level flight attitude where a required TCA 214 has been set to 700 feet, the illustrative value of the required TCA 214 discussed above. A comparison between the values shown in FIG. 6 and FIG. 9 shows the 700 feet difference for each terrain cell, the value of the required TCA 214 of an aircraft in level flight in the enroute phase of flight. Likewise, a comparison between the values shown in FIG. 8 and FIG. 9 shows how the minimum operating altitudes 216 of the same cells may be different because of a change in phase in flight.

Figure 10:
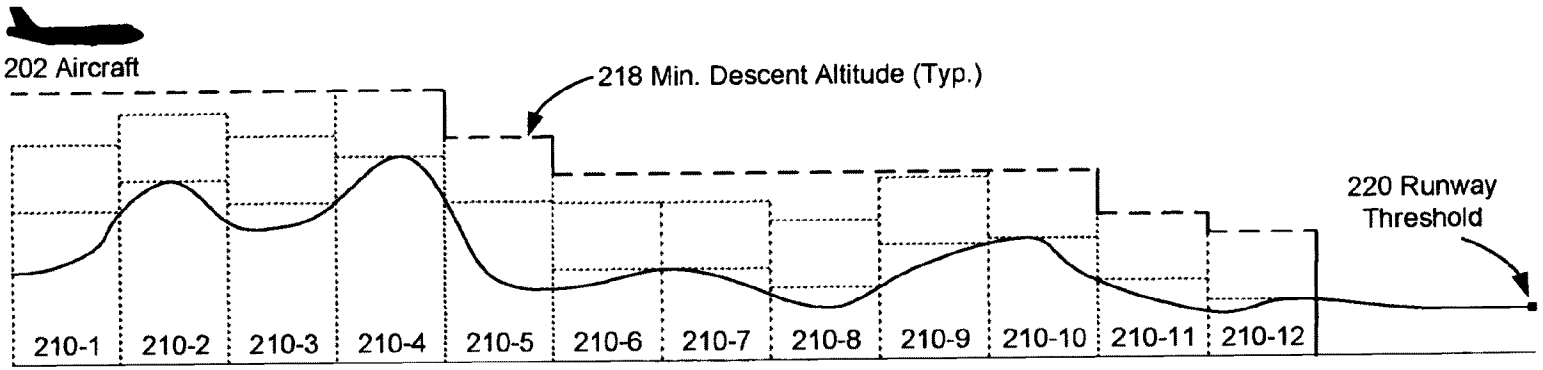
FIG. 10 provides an exemplary illustration of terminologies that may be used in the embodiments herein.
Figure 11:
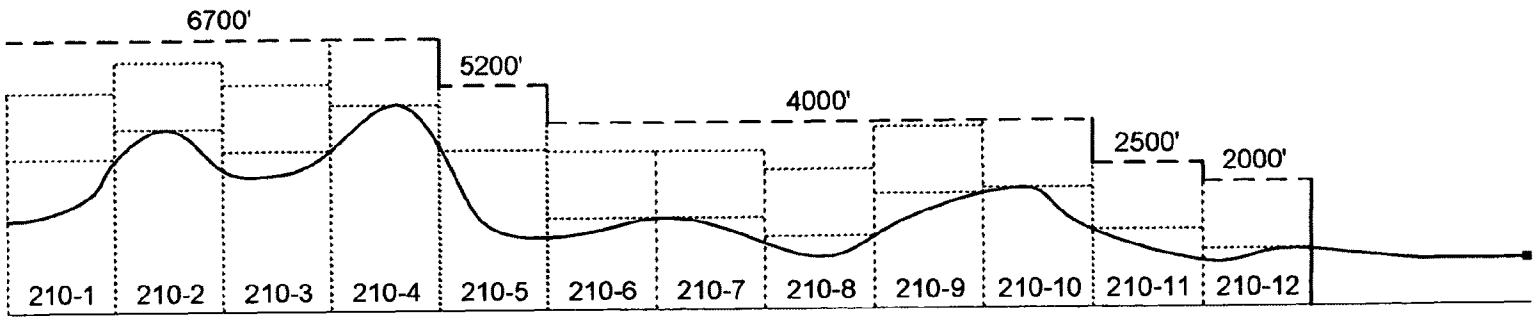
FIG. 11 provides an exemplary illustration of a plurality of terrain cell altitude data.

FIGS. 10 and 11 provide an illustration of an embodiment in which minimum descent altitudes 218 is determined from a runway threshold 220. In one embodiment, the value of a minimum descent altitude 218 is equal to (a) the value of the current minimum operating altitude 216 of the terrain cell over which the aircraft is operating if the value of current minimum operating altitude is greater than or equal to each value of the plurality of projected minimum operating altitudes 216 or (b) the greatest value among the plurality of values of projected minimum operating altitudes 216 if the value of the current minimum operating altitude 216 is less than at least one of the values among the plurality of values of projected minimum operating altitudes 216.

FIG. 11 illustrates the application of this embodiment of determining minimum descent altitudes for a plurality of projected terrain cells and forming a minimum descent profile. The plurality of terrain cells 210-1 through 210-12 corresponding to the projected flight path is depicted. The minimum operating altitudes for the plurality of terrain cells are also shown (without the values being depicted). From the current terrain cell 210-1 corresponding to the current location of aircraft 202, the plurality of projected terrain cells between the current position of the aircraft 202 and runway threshold 220 are examined to determine whether the minimum operating altitude of the current terrain cell is less than any of the minimum operating altitudes of the plurality of projected terrain cells 210-2 through 210-12. Upon examination of FIG. 10 where it is based upon an aircraft operating in the approach phase of flight in a descending flight attitude, the minimum operating altitude of cell 210-1 of 5,000 feet is less than cells 210-2 through 210-4 which have minimum operating altitudes of 6000 feet, 5200 feet, 6700 feet, respectively. Because the greatest of these values is 6700 feet for cell 210-4, the minimum descent altitude for each of the terrain cells between cells 210-1 and 210-4, inclusive, is set to 6700 feet as shown in FIG. 11. Then, this process is repeated by continuing with the next terrain cell 210-5.

The minimum operating altitude for terrain cell 210-5 is 5200 feet as shown in FIG. 8, and there are no other terrain cells in the remaining plurality of terrain cells less than this value; therefore, the minimum descent altitude for terrain cell 210-5 is set to 5200 feet as shown in FIG. 11. Continuing with the next terrain cell 210-6, it is noted in FIG. 8 that the minimum operating altitude of 3100 feet for terrain cell 210-6 is less than cells 210-9 and 210-10 which have minimum operating altitudes of 3800 feet and 4000 feet, respectively. Because the greatest of these values is 4000 feet for cell 210-10, the minimum descent altitude for each of the terrain cells 210-6 through 210-10, inclusive, is set to 4000 feet as shown in FIG. 11. Continuing with the next terrain cell 210-11, the minimum operating altitude is 2500 feet, and there are no other terrain cells in the remaining plurality of terrain cells less than this value; therefore, the minimum descent altitude for terrain cell 210-11 is set to 2500 feet as shown in FIG. 11. Continuing with the next terrain cell 210-12, the minimum operating altitude is 2000 feet, and this is the last remaining terrain cell from the plurality of terrain cells; therefore, the minimum descent altitude for terrain cell 210-12 is set to 2000 feet as shown in FIG. 11.

Alternatively, beginning at the terrain cell closest to the runway threshold 220, the minimum descent altitude is set to the minimum operating altitude of 2000 feet of the terrain cell 210-12. Next, proceeding outwardly from the runway and along the projected flight path, the bordering terrain cell 210-11 is examined to determine whether its minimum operating altitude is greater than the minimum descent altitude of 210-12, and if it is, then the minimum descent altitude is set to be its corresponding minimum operating altitude. The minimum operating altitude for terrain cell 210-11 is 2500 feet as shown in FIG. 8, and because its minimum operating altitude is greater than the minimum descent altitude of 2000 feet of 210-12, the minimum operating altitude for terrain cell 210-11 is set to 2500 feet. Then, this process is repeated by proceeding outwardly from the runway threshold 220 and along the projected flight path for the remaining plurality of projected terrain cells.

The minimum operating altitude for terrain cell 210-10 is 4000 feet as shown in FIG. 8, and because its minimum operating altitude is greater than the minimum descent altitude 218 of 2500 feet of 210-11, the minimum descent altitude for terrain cell 210-10 is set to 4000 feet. Continuing with the next outwardly adjacent terrain cell, the minimum operating altitude 216 for terrain cell 210-9 is 3800 feet, and because its minimum operating altitude is not greater the minimum descent altitude of 4000 feet, the minimum descent altitude for terrain cell 210-9 is set to 4000 feet. Continuing with the next three outwardly adjacent terrain cells, the minimum operating altitude for terrain cells 210-8 through 210-6 are not greater the minimum descent altitude of 4000 feet for terrain cell 210-9, and as such, the minimum descent altitudes for terrain cell 210-8 through 210-6, inclusive, are set to 4000 feet. Continuing with the next outwardly adjacent terrain cell, the minimum operating altitude 216 for terrain cell 210-5 is 5200 feet, and because its minimum operating altitude is greater the minimum descent altitude of 4000 feet, the minimum descent altitude 218 for terrain cell 210-5 is set to 5200 feet. Continuing with the next outwardly adjacent terrain cell, the minimum operating altitude for terrain cell 210-4 is 6700 feet, and because its minimum operating altitude is greater the minimum descent altitude of 5200 feet, the minimum descent altitude for terrain cell 210-4 is set to 6700 feet. Continuing with the next three outwardly adjacent terrain cells, the minimum operating altitude for terrain cells 210-3 through 210-1 are not greater the minimum descent altitude of 6,700 feet for terrain cell 210-4, and as such, the minimum descent altitudes for terrain cell 210-3 through 210-1, inclusive, are set to 6700 feet.

Figure 12:
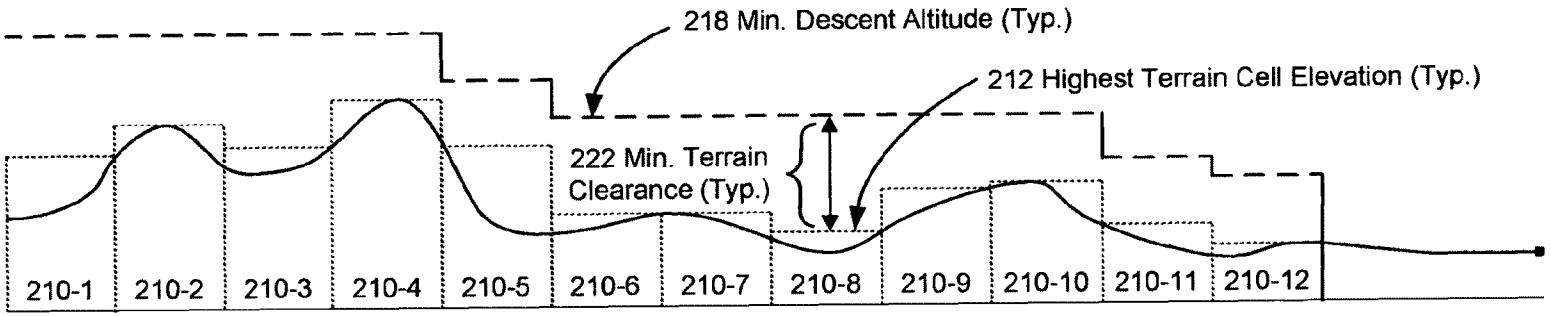
FIG. 12 provides an exemplary illustration of terminologies that may be used in the embodiments herein.
Figure 13:
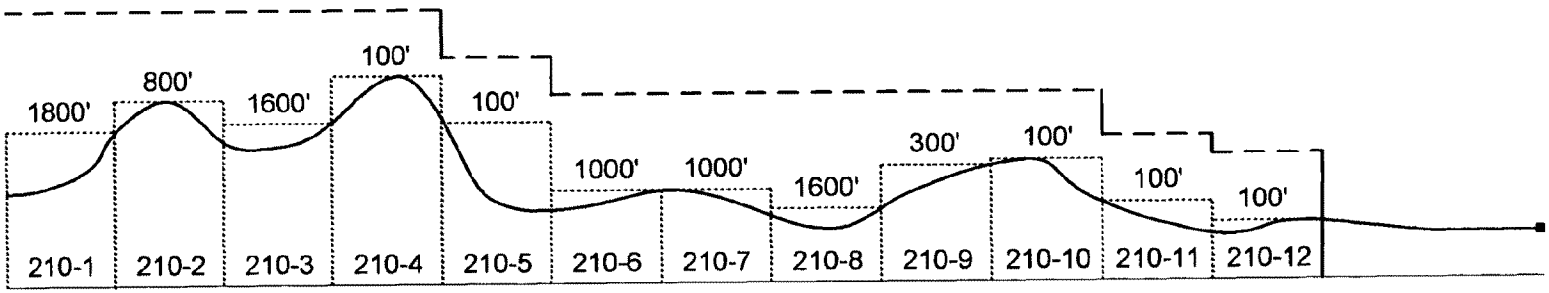
FIG. 13 provides an exemplary illustration of a plurality of terrain cell altitude data.

FIG. 12 provides an illustration of an embodiment in which a minimum terrain clearance altitude 222 is depicted as a function of minimum descent altitude 218 and highest terrain cell elevation 212 for each terrain cell. Generally, the minimum terrain clearance altitude 222 is the difference between the minimum descent altitude 218 and the highest terrain cell elevation 212. For the purposes of illustration, the values determined for the minimum descent altitude 218 for each cell as shown in FIG. 11 and highest terrain cell elevation 212 as shown in FIG. 6 will be used. By subtracting the values for each terrain cell shown in FIG. 11 from those corresponding values shown in FIG. 6, the minimum terrain clearance altitude 222 for each cell is determined, and these values are shown in FIG. 13. For example, the minimum terrain clearance altitude 212 for terrain cell 210-2 is set to 800 feet as shown in FIG. 11, the difference between the minimum descent altitude 218 of 6700 feet and highest terrain cell elevation 212 of 5900 feet. Likewise, the minimum terrain clearance altitude 222 for terrain cell 210-10 is set to 100 feet, the difference between the minimum descent altitude 218 of 4000 feet and the highest terrain cell elevation 212 of 3900 feet.

Figure 14:
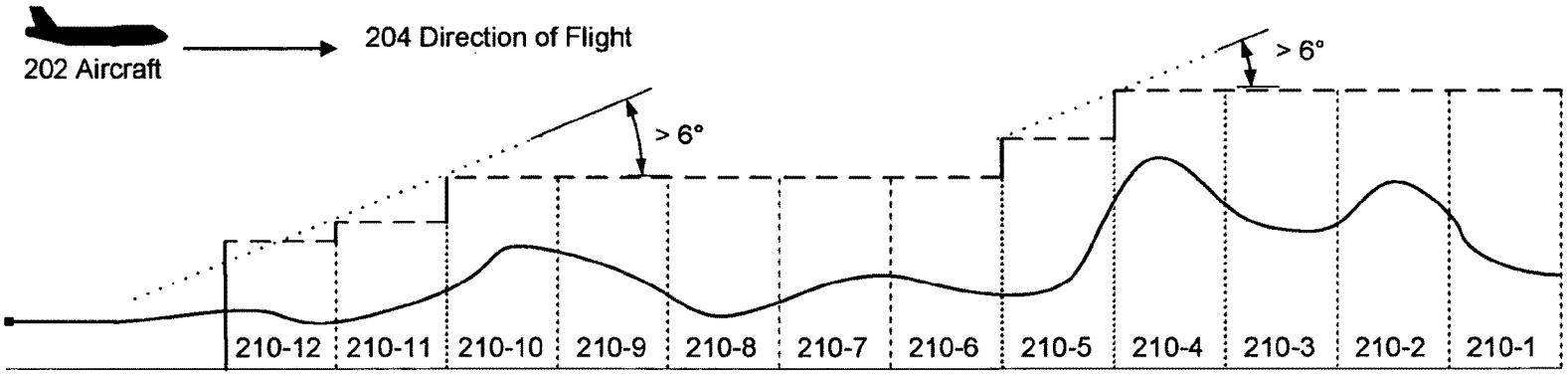
FIG. 14 provides an exemplary illustration of a plurality of terrain cells corresponding to an ascent flight profile.
Figure 15:
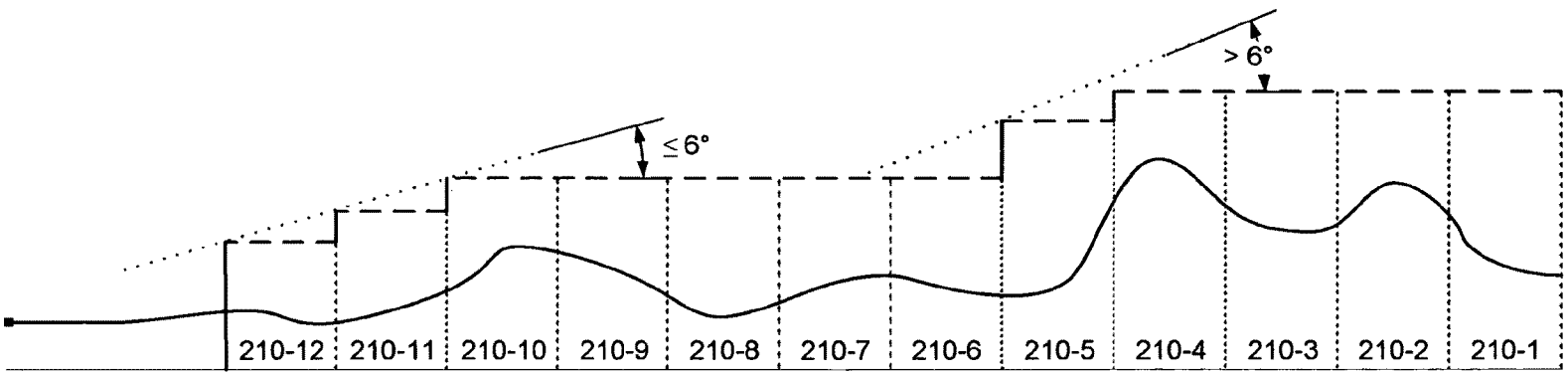
FIG. 15 provides an exemplary illustration of a plurality of terrain cells corresponding to an ascent flight profile.
Figure 16:
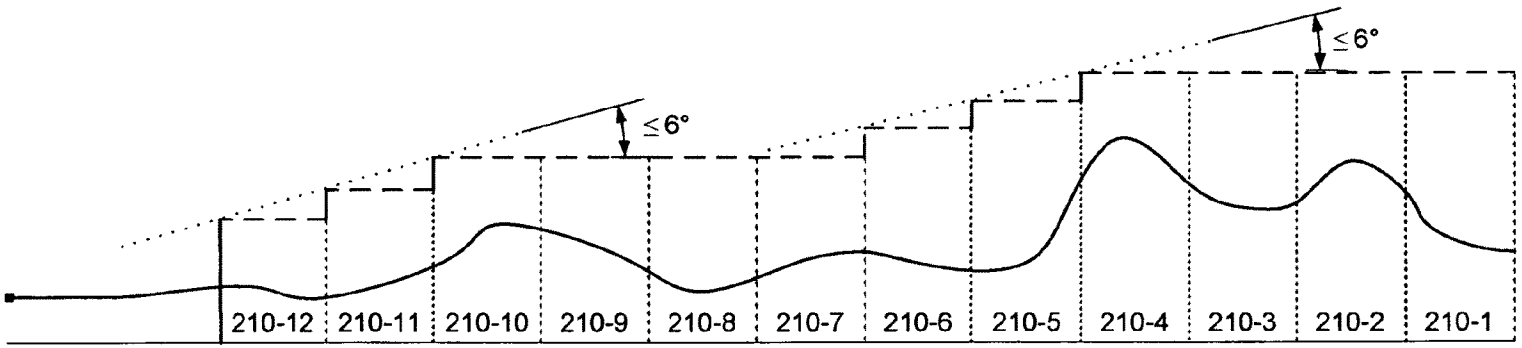
FIG. 16 provides an exemplary illustration of a plurality of terrain cells corresponding to an ascent flight profile.

FIGS. 14 through 17 provide an illustration of an embodiment in which a minimum ascent altitude 224 (see FIG. 17) is determined for each terrain cell. Generally, the minimum ascent altitude 224 is determined as a function of minimum descent altitude 218 and a pre-defined maximum angle of climb. In other words, the minimum ascent altitude 224 may also be considered a function of minimum operating attitude 216 and a climb gradient. For the purposes of illustration herein, the pre-defined climb gradient or pre-defined maximum angle of climb will be equal to 6 degrees as shown in FIGS. 14 through 16.

FIG. 14 provides an exemplar depiction of a mirror image of the profile of a mountainous or hilly terrain 200 over which an aircraft 202 may encounter in the projected direction of flight 204 that was introduced in FIG. 4 and repeatedly referenced in FIGS. 5 through 13. The values of the highest terrain cell elevation 212 and minimum descent altitude 218 for each terrain cell are assumed to be the same for terrain cell 210-1 through 210-12 shown in FIGS. 14 through 17.

Initially, the minimum ascent altitude for each terrain cell would be set to the same value as the minimum descent altitude for each terrain cell. However, an additional assurance is required to confirm that the angle formed between the leading edge of two adjacent terrain cells does not exceed the pre-determined angle of climb. If the angle of climb is exceeded, then the maximum ascent altitude of the terrain cell closer to the runway threshold will have to be increased to an altitude which ensures the angle of climb between two adjacent terrain cells does not exceed the angle of climb.

For example, referring to FIG. 14, the angle of climb between terrain cells 210-11 and 210-10 is greater than 6 degrees, where the minimum ascent altitude is 2500 feet for 210-11 and 4000 feet for terrain cell 210-10 (the initial values which correspond to the minimum descent altitudes shown in FIG. 11). As such, minimum ascent altitude of terrain cell 210-11 will have to be increased until the angle of climb is 6 degrees or less. In this example, setting the minimum ascent altitude to 3000 feet will ensure the maximum angle of climb between the leading edges of terrain cells 210-11 and 210-10 will not be exceeded as shown in FIG. 15.

Figure 17:
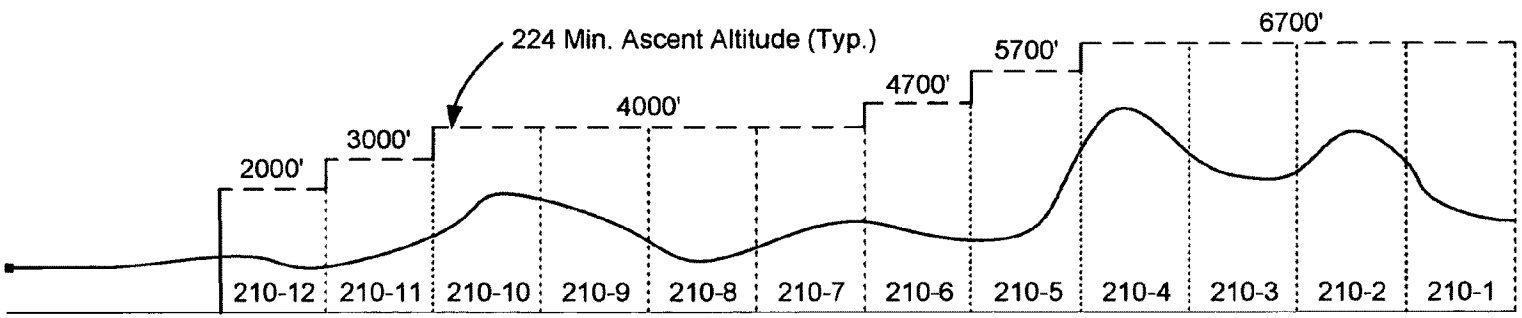
FIG. 17 provides an exemplary illustration of terminology that may be used in the embodiments herein.

In addition, the angle of climb between terrain cells 210-5 and 210-4 is greater than 6 degrees, where the minimum ascent altitude is 5200 feet for 210-5 and 6700 feet for terrain cell 210-4 (the initial values which correspond to the minimum descent altitudes shown in FIG. 11). As such, minimum ascent altitude of terrain cell 210-5 will have to be increased until the maximum angle of climb is 6 degrees or less. In this example, setting the minimum ascent altitude to 5700 feet will ensure the maximum angle of climb between the leading edges of terrain cells 210-5 and 210-4 will not be exceeded as shown in FIG. 15. However, setting the minimum ascent altitude of terrain cell 210-5 to 5700 feet has resulted with the angle of climb that is greater than 6 degrees between terrain cells 210-6 and 210-5 as shown in FIG. 15. As such, the minimum ascent altitude will have to be increased. In this example, setting the minimum ascent altitude of 4700 feet (from the minimum descent altitude of 4000 feet shown in FIG. 11) will ensure the maximum angle of climb between the leading edges of terrain cells 210-6 and 210-5 will not be exceeded as shown in FIGS. 16 and 17.

Figure 18:
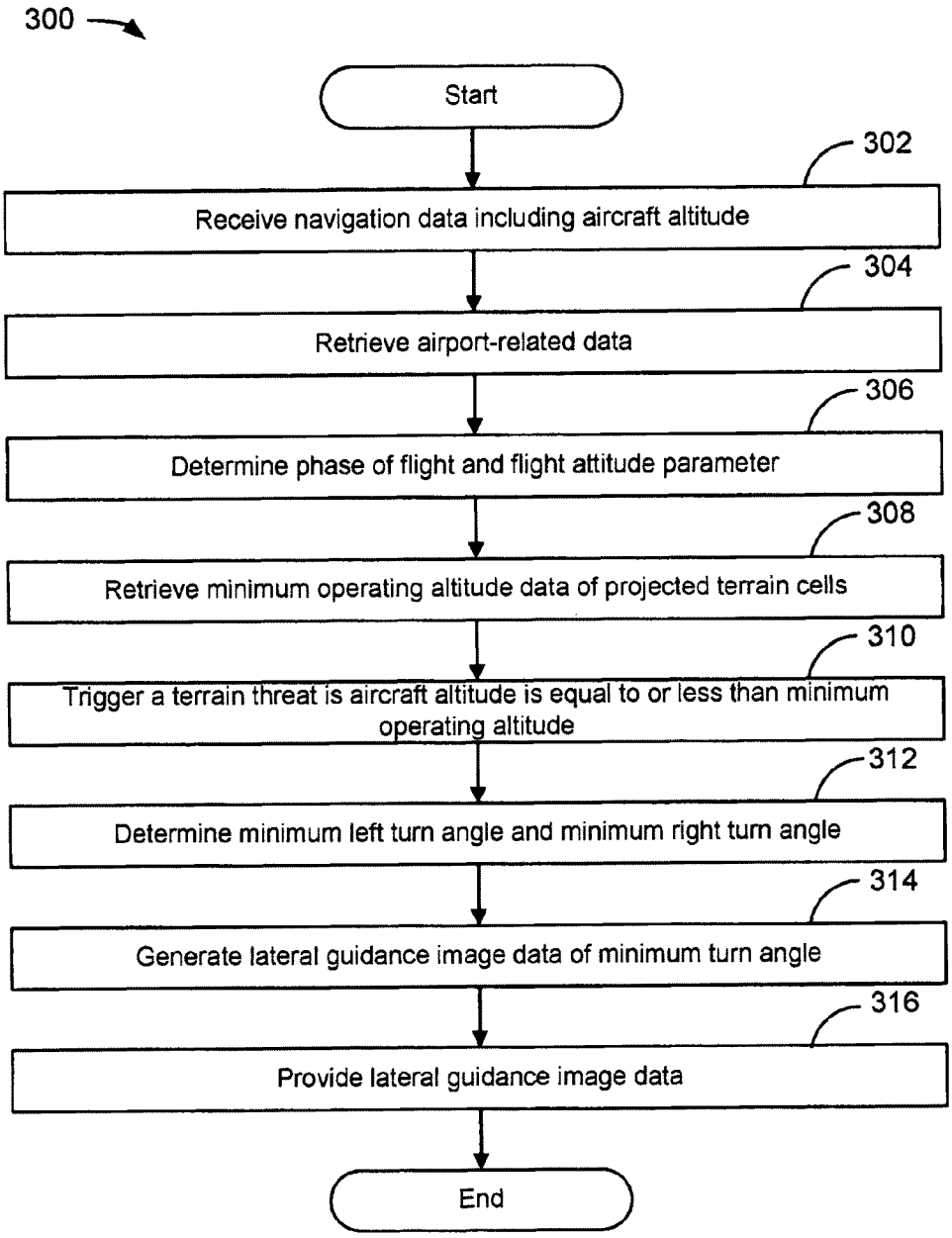
FIG. 18 provides a flowchart illustrating a method for generating lateral guidance in a terrain-awareness and warning system.

FIG. 18 depicts a flowchart 300 of an example of a method for generating lateral guidance in a terrain awareness and warning system. The flowchart begins with module 302 with the receiving of navigation data including aircraft position, altitude and attitude of the aircraft in flight. The navigation data could be provided by a navigation system 110. Attitude data 116 could indicate the flight attitude of the aircraft, e.g., climbing, descending, or level flight. Altitude data could be used to compute the phase of flight, e.g., enroute, terminal, approach, or departure. The flowchart continues with module 304 with the retrieving of airport-related data of nearest airport which could be used in the determination of the phase of flight and flight attitude parameter. Distances from airports, runways, runway threshold, or a combination of all of these may be used to determine the phase of flight of the aircraft. The flowchart continues with module 306 with the determining of a phase of flight and flight attitude parameter using the navigation data and airport-related data. This value could be written into the software being executed by a lateral guidance processor 150 or could be stored in a database and retrieved by the lateral guidance processor 150.

The flowchart continues with module 308 with the retrieving terrain data of a terrain cell from a terrain database 140, the location of which corresponds to the aircraft position. A terrain database 140 could store terrain data of a plurality of terrain cells, wherein each terrain cell includes data representative of a value of a minimum operating altitude 216. In the embodiment of FIG. 18, data contained in a terrain data cell of a minimum operating altitude 216 could be the sum of the highest elevation found within the terrain cell and a required terrain clearance altitude 214 specified in a terrain awareness and warning system, where the minimum operating altitude 216 may depend upon a phase of flight and flight attitude. The terrain database 140 could store a minimum operating altitude 216 per phase of flight and flight altitude in one embodiment. In another embodiment, a terrain database 140 may be comprised of a plurality of databases, where each database stores one or more minimum operating altitudes 216 corresponding to specific phases of flight and flight attitudes.

The flowchart continues with module 310 with the triggering of a terrain threat if the value of the aircraft altitude 114 is less than the value of the minimum operating altitude 216. In another embodiment, the user may wish to configure the threat to trigger when the altitude 114 is equal to the value of the minimum operating altitude 216. In the embodiment of FIG. 18, this may be considered as a first terrain threat if the lateral guidance processor 150 is configured to generate additional threats based upon other conditions.

In another embodiment, a plurality of minimum operating altitudes may be used to determine a minimum descent altitude 218 along a projected flight path. If the navigation system provides data representative of vertical speed 122, then an alert clearance altitude may be determined as a function of the vertical speed data 122 and phase of flight and flight attitude parameter. Then, a descent trigger altitude could be determined as a function of minimum descent altitude 218 and the alert clearance altitude, and another terrain threat could be triggered if the aircraft altitude 114 is less than the descent trigger altitude. Alternatively, the terrain threat could also be triggered when the aircraft altitude 114 is equal to the descent trigger altitude.

In another embodiment, the terrain guidance processor 150 could generate an alert contemporaneously with the triggering of the terrain threat. An alert may be provided to a crew alerting system 170, a system which may comprise of a display unit and an aural alert unit. An alert may cause a plurality of colors to be displayed that are similar to the visual alerts associated with a terrain awareness and warning system. An alert may also cause an aural alert to be presented to the pilot. In addition, the display unit on which the visual alerts may be displayed could be the same or different unit than that of the crew alerting system.

In another embodiment, a plurality of minimum operating altitudes may be used to determine a minimum ascent altitude 224 along a projected flight path. If the navigation system provides data representative of vertical speed 122 and aircraft speed 118, then an alert clearance altitude may be determined as a function of the vertical speed data 122 and phase of flight and flight attitude parameter. Then, an ascent trigger altitude could be determined as a function of minimum ascent altitude 224 and the alert clearance altitude, and another terrain threat could be triggered if the aircraft altitude 114 is less than the descent trigger altitude. Alternatively, the terrain threat could also be triggered when the aircraft altitude 114 is equal to the descent trigger altitude.

The flowchart continues with module 312 with the determining of a value of a first minimum left turn angle and a value of a first minimum right turn angle. An angle could be formed between the projected flight path and vectors to the left, right, or both, in which each passes through a point tangent to a boundary of a lateral terrain threat. The flowchart continues with module 314 with the generating of lateral guidance image data representative of the smaller angle between the minimum left turn angle and the minimum right turn angle. In another embodiment, the lateral guidance image data representative of the larger angle may be generated. The flowchart continues with module 316 with the providing of the lateral image guidance data to a terrain indicating system 160 and subsequent presentation to the pilot on a terrain display unit. In an alternative embodiment, such presentation may overlay information presented by another system of the aircraft. Then, the flowchart proceeds to the end.

It should be noted that the method steps described above are embodied in computer-readable media as computer instruction code. It shall be appreciated to those skilled in the art that not all method steps described must be performed, nor must they be performed in the order stated.

As used herein, the term "embodiment" means an embodiment that serves to illustrate by way of example but not limitation.

It will be appreciated to those skilled in the art that the preceding examples and embodiments are exemplary and not limiting to the scope of the present invention. It is intended that all permutations, enhancements, equivalents, and improvements thereto that are apparent to those skilled in the art upon a reading of the specification and a study of the drawings are included within the true spirit and scope of the present invention. It is therefore intended that the following appended claims include all such modifications, permutations and equivalents as fall within the true spirit and scope of the present invention.

What is claimed is:

1. A system for generating lateral guidance information in a terrain awareness and warning system of an aircraft, said system comprising:

a navigation system for acquiring navigation data;

at least one terrain database comprised of terrain data stored as a plurality of terrain cells of a digital elevation model, wherein such terrain data is comprised of terrain cell location information and at least one value of a terrain cell minimum operating altitude, where each value of a terrain cell minimum operating altitude is associated with a stored parameter representing phase of flight and flight attitude;

an airport database comprised of airport-related data;

a lateral guidance processor, electronically coupled to receive navigation data, terrain data, and airport-related data, wherein such processor receives navigation data representative of at least aircraft position, a value of aircraft altitude, and projected flight path of an aircraft in flight, retrieves airport-related data of the nearest airport from the aircraft position, determines a parameter based upon the navigation data and the airport-related data, where such determined parameter represents phase of flight and flight attitude, retrieves terrain data representative of one value of a terrain cell minimum operating altitude of each terrain cell located in front of the aircraft, where such retrieval is based upon the determined parameter, triggers a first terrain threat if the value of the aircraft altitude is equal to or less than any one value of a terrain cell minimum operating altitude of any retrieved terrain cell located along the projected flight path, determines a value of a first minimum left turn angle and a value of a first minimum right turn angle if the first terrain threat is triggered, where the value of each angle is measured from the projected flight path, generates first lateral guidance image data based upon the smaller of angles between the first minimum left turn angle and the first minimum right turn angle, wherein such first lateral guidance image data is representative of an image of first lateral guidance information, and provides the first lateral guidance image data to a terrain indicating system; and the terrain indicating system, electronically coupled to receive lateral guidance image data, where such terrain indicating system receives the first lateral guidance image data, and presents the image of first lateral guidance information represented in the first lateral guidance image data on a visual display unit.

2. The system of claim 1, wherein the lateral guidance processor generates second lateral guidance image data based upon the larger of angles between the first minimum left turn angle and the first minimum right turn angle, wherein such second lateral guidance image data is representative of an image of second lateral guidance information, and provides the second lateral guidance image data to the terrain indicating system; and the terrain indicating system receives the second lateral guidance image data, and presents the image of second lateral guidance information represented in the second lateral guidance image data on the visual display unit.

3. The system of claim 1, wherein the lateral guidance processor receives navigation data representative of vertical speed of the aircraft in flight, determines a value of a minimum descent altitude as a function of a value of the highest terrain cell minimum operating altitude among each retrieved terrain cell located along the projected flight path, determines a value of a first alert clearance altitude as a function of the vertical speed and the determined parameter, determines a value of a descent trigger altitude as a function of the value of the minimum descent altitude and the value of the first alert clearance altitude, triggers a second terrain threat if the value of the aircraft altitude is equal to or less than the value of the descent trigger altitude, determines a value of a second minimum left turn angle and a value of a second minimum right turn angle if the second terrain threat is triggered, where the value of each such angle is measured from the projected flight path, generates third lateral guidance image data based upon the smaller of angles between the second minimum left turn angle and the second minimum right turn angle, wherein such third lateral guidance image data is representative of an image of third lateral guidance information, and provides the third lateral guidance image data to the terrain indicating system; and the terrain indicating system receives the third lateral guidance image data, and presents the image of the third lateral guidance information represented in the third lateral guidance image data on the visual display unit.

4. The system of claim 3, wherein the lateral guidance processor generates fourth lateral guidance image data based upon the larger of angles between the second minimum left turn angle and the second minimum right turn angle, wherein such fourth lateral guidance image data is representative of an image of fourth lateral guidance information, and provides the fourth lateral guidance image data to the terrain indicating system; and the terrain indicating system receives the fourth lateral guidance image data, and presents the image of the fourth lateral guidance information represented in the fourth lateral guidance image data on the visual display unit.

5. The system of claim 1, wherein the lateral guidance processor receives navigation data representative of vertical speed and speed of the aircraft in flight, retrieves terrain data representative of terrain cell location information of each terrain cell located in front of the aircraft, determines a value of a minimum ascent altitude as a function of the value of the terrain cell minimum operating altitude for each terrain cell located along the projected flight path, the location of a leading edge of each terrain cell located in front of the aircraft, speed, and a configurable climb gradient, determines a value of a second alert clearance altitude as a function of the vertical speed and the determined parameter, determines a value of an ascent trigger altitude as a function of the value of the minimum ascent altitude and the value of the second alert clearance altitude, triggers a third terrain threat if the value of the aircraft altitude is equal to or less than the value of the ascent trigger altitude, determines a value of a third minimum left turn angle and a value of a third minimum right turn angle if the third terrain threat is triggered, where the value of each such angle is measured from the projected flight path, generates fifth lateral guidance image data based upon the smaller of angles between the third minimum left turn angle and the third minimum right turn angle, wherein such firth lateral guidance image data is representative of an image of fifth lateral guidance information, and provides the fifth lateral guidance image data to the terrain indicating system; and the terrain indicating system receives the fifth lateral guidance image data, and presents the image of the fifth lateral guidance information represented in the fifth lateral guidance image data on the visual display unit.

6. The system of claim 5, wherein the lateral guidance processor generates sixth lateral guidance image data based upon the larger of angles between the third minimum left turn angle and the third minimum right turn angle, wherein such sixth lateral guidance image data is representative of an image of sixth lateral guidance information, and provides the sixth lateral guidance image data to the terrain indicating system; and the terrain indicating system receives the sixth lateral guidance image data, and presents the image of the sixth lateral guidance information represented in the sixth lateral guidance image data on the visual display unit.

7. The system of claim 1, wherein the value of the first minimum left turn angle and the value of the first minimum right turn angle are determined as a function of locations of tangents associated with a level of terrain threat to the left and to the right of the projective flight path, respectively.

8. The system of claim 1, further comprising a crew alerting system electronically coupled to receive alert data generated by the lateral guidance processor when the first terrain threat is triggered.

9. The system of claim 8, wherein the crew alerting system is comprised of a second visual display unit.

10. The system of claim 9, wherein the crew alerting system receives alert data representative of a colored image, where the color of the image corresponds to a level of terrain threat, and presents the colored image represented in the alert data on the second visual display unit.

11. The system of claim 10, wherein the second visual display unit is the visual display unit of the terrain indicating system.

12. The system of claim 8, wherein the crew alerting system is comprised of an aural alert unit.

13. The system of claim 12, wherein the crew alerting system receives alert data representative of an aural alert corresponding to a level of terrain threat, and presents the aural alert represented in the alert data through the aural alert unit.

* * * * *